US005700524A

United States Patent [19]

Hoff et al.

[11] Patent Number: 5,700,524

[45] Date of Patent: *Dec. 23, 1997

[54] HIGH SPEED COATING STARTS USING A SHEAR THINNING TOP LAYER

[75] Inventors: Joseph W. Hoff, Fairport; Douglas S. Finnicum, Webster; Steven J. Weinstein, Fairport, all of N.Y.

[73] Assignee: Eastman Kodak Company, Rochester, N.Y.

[ * ] Notice: The term of this patent shall not extend beyond the expiration date of Pat. No. 5,683,750.

[21] Appl. No.: 688,487

[22] Filed: Jul. 30, 1996

[51] Int. Cl.[6] ..... B05D 1/30; B05D 1/26

[52] U.S. Cl. ..... 427/402; 427/420; 118/411; 118/324; 118/DIG. 4

[58] Field of Search ..... 427/420, 402; 118/410, 411, 324, DIG. 4

[56] References Cited

U.S. PATENT DOCUMENTS

| | | | |
|---|---|---|---|
| 3,220,887 | 11/1965 | Johnson | 117/120 |
| 3,959,528 | 5/1976 | Takeda et al. | 427/290 |
| 4,113,903 | 9/1978 | Choinski | 427/420 |
| 4,340,621 | 7/1982 | Matsumiya et al. | 427/294 |
| 4,525,392 | 6/1985 | Ishizaki et al. | 427/420 |
| 4,571,849 | 2/1986 | Gardner et al. | 34/79 |
| 4,808,444 | 2/1989 | Yamazaki et al. | 427/420 |
| 4,863,765 | 9/1989 | Ishizuka | 427/420 |
| 4,976,999 | 12/1990 | Ishizuka | 427/420 |
| 5,340,616 | 8/1994 | Amano et al. | 427/458 |
| 5,391,401 | 2/1995 | Blake et al. | 427/407.1 |
| 5,399,385 | 3/1995 | Joos et al. | 427/420 |
| 5,505,995 | 4/1996 | Leonard | 427/420 |

*Primary Examiner*—Katherine A. Bareford
*Attorney, Agent, or Firm*—Arthur H. Rosenstein

[57] ABSTRACT

A method of coating moveable supports at high speeds comprises moving a support along a path through a coating zone; forming two or more layers including a topmost layer of coating liquids to form a liquid coating composition; and applying the liquid coating composition to the moving support wherein the topmost layer of the liquid coating composition is shear thinning.

8 Claims, 2 Drawing Sheets

HIGH SPEED COATING STARTS USING A SHEAR THINNING TOP LAYER

FIELD OF THE INVENTION

The present invention concerns a method for initiating or starting the coating of moving supports. Such method is particularly suitable for coating products in strip form, such as for example, photographic film, paper or cloth. More particularly, the invention relates to a method of increasing the range of support speeds over which a coating may be initiated.

BACKGROUND OF THE INVENTION

In curtain coating and bead coating operations, it is customary to apply liquid composition to a moving strip material (hereinafter referred to as a "support") by flowing the composition through a slot in a metering device (hereinafter referred to as "hopper"). These methods have been somewhat satisfactory in that uniform and useful coatings have been produced, but the speed of application is limited. To increase manufacturing productivity, factors limiting speeds at which coating operations take place need to be relaxed.

Prior art in the field (Kistler, Wettability, Vol. 49, Surfactant Science Series, Marcel Dekker, Inc.,) has established that a necessary condition for creating a uniform coating on a moving support is that the composition to be coated must displace any air that is entrained on the moving support. Failure to displace this air is termed wetting failure and will result in a non-uniform, and hence non-useful, coating. Wetting failure can be influenced by the speed of the support at which the coating operation takes place. Additionally, prior art has established that the viscosity of the coating composition is a predominant parameter that affects the speed of the support at which wetting failure will occur. Higher viscosity coating compositions will generally exhibit wetting failure at lower support speeds than a correspondingly lower viscosity coating composition.

For instance, in the bead coating process, a coating pack composed of one or more fluid layers is transferred from the hopper to a moving support. Prior to a coating event, the hopper is separated from the support by such a distance that a coating composition cannot physically contact the support. The coating composition flows over the edge of the hopper and into a vacuum trough that doubles as a sink. Once the hopper is prepared for the coating event, the distance between the hopper and the coating roll is decreased. A coating start refers to the moment when the coating composition contacts the support and a coating bead forms (the bead is defined as the region filled with fluid between the hopper and support).

The coating start is fundamental to the coating process. A good coating start can be defined as the transferal of coating fluids from a hopper to a moving support that results in an uniform coating in directions both parallel and perpendicular to the conveying direction of the support. If a coating start cannot be made at a given speed, no successful coating can be attained; even if a coating start can be made, a suboptimal start can create problems that can have lasting effects on a coating event. These problems include streak waste. As might be expected, achieving an imperfection-free coating start is a non-trivial part of the coating process.

During the coating start, the top-most layer of the coating composition is the initial layer to contact the moving support. As taught in U.S. Pat. No. 4,572,849 (Koepke), this layer will have a viscosity greater than the bottom most layer. Inferring from cited literature, use of a high viscosity top layer will decrease the range of support speeds at which an acceptable coating start can be made. A low viscosity fluid coats better than a high viscosity fluid. Different viscosities are preferred in different parts of the coating process. A high viscosity top layer is preferred on the hopper slide and support during steady-state coating, but low viscosity is preferred at the coating bead during the start.

In order to achieve a good coating start, three criteria must be satisfied. The first necessary condition for a coating start is that there be enough coating fluid to bridge the gap between the hopper and support. Generally this is not a problem. However, elevated levels of vacuum may thin a coating composition to the extent where it can no longer touch the support. Similarly, an improperly set spacing between the hopper and support may also create such a problem. Severe cases of mechanical distortion of the hopper, or a misaligned hopper can result in a non-uniform fluid contact with a support. A non-uniformly applied vacuum or an improperly prepared hopper can lead to non-uniform fluid contact with a support as well.

The second necessary condition is that the support and the coating composition must be compatible. If they are not, wetting failure, as characterized by the irregular entrainment of air between the liquid and support, will occur at a coating start. In extreme cases, a coating fluid will overflow the edging hardware instead of dynamically wetting the support. In the case where one is successfully coating yet progressively raises the coating speed, wetting failure will ultimately arise.

Thus, a third necessary condition is that the speed of the support, as it moves through the coating zone, must be below the wetting failure speed. Wetting failure speed is a practical limit of speed on a coating start. The problem of attaining acceptable coating starts has been addressed for instance in U.S. Pat. No. 3,220,877 where air pressure differential is used and in U.S. Pat. No. 3,959,528 where roughening the surface of a portion of the support surface avoids a thick coating at the start. In U.S. Pat. No. 4,340,621 it is taught that a pressure reduction of a bead stability suction chamber is set at a value higher than that used for steady-state operation. U.S. Pat. No. 4,808,444 discloses a backing roller which is rapidly moved by a pneumatic mechanism relative to the hopper between positions at which the composition can and cannot be applied to the traveling web in order to avoid thick coating at a leading portion or at a spliced portion of the web. U.S. Pat. No. 5,340,616 teaches the use of an electric field whose level is greater than the steady state coating electric field level.

The present patent application provides a novel technique for increasing the attainable speeds for a coating start while not interfering with the normal, steady-state coating operation.

SUMMARY OF THE INVENTION

An object of this invention is to provide a coating method in which, in addition to maintaining steady-state coating operations, the problems associated, with start-up coatings are corrected.

This object and others in coating moving strips at high speed are met by using a method for applying multiple layers of coating liquids to a moving support comprising moving a support along a path through a coating zone; forming two or more layers including a topmost layer of coating liquids to form a liquid coating composition; and applying the liquid coating composition to the moving support wherein the topmost layer of the liquid coating composition or the layer to first contact the support at a coating start, is shear thinning. This invention addresses the liquid-support incompatibility issue, by specifically using a shear thinning formulation, which has the transient property that the top layer acts as low viscosity at the coating start. The low viscosity in the top layer is only transient in nature, in that the shear thinning top layer easily attains the high viscosity necessary for steady-state coating.

The nature, principle and utility of the invention will become more apparent from the following detailed description when read in conjunction with the accompanying drawings.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

Figure 1:
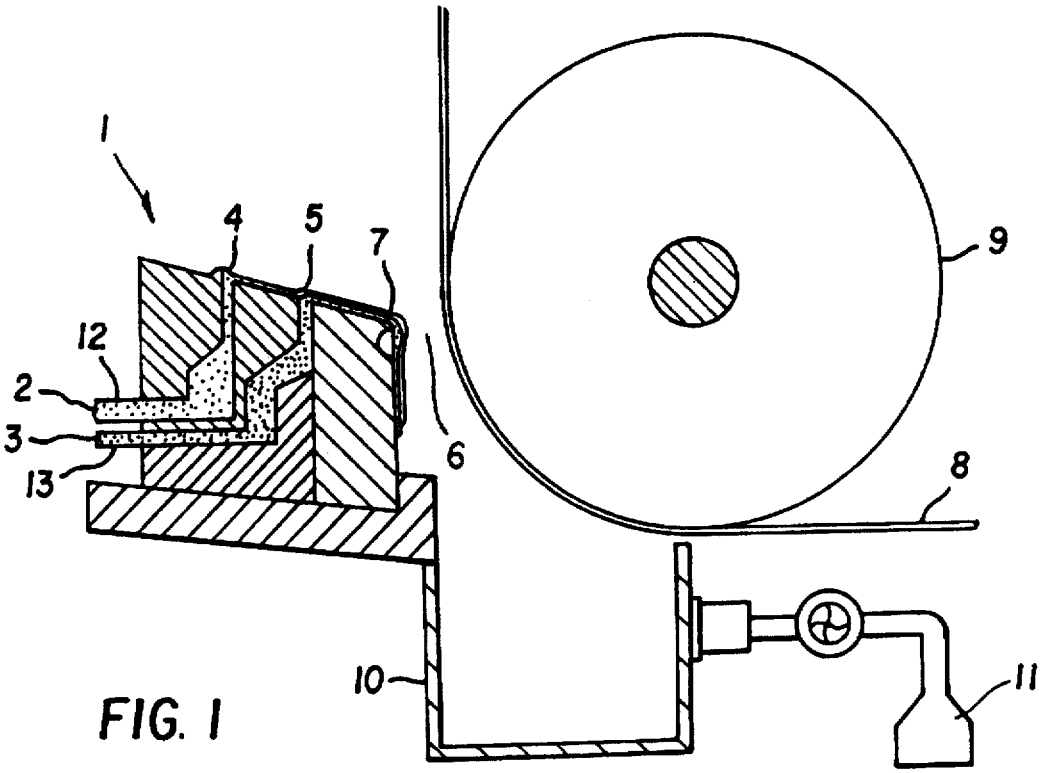
FIG. 1 is a drawing of the coating configuration prior to a coating start.
Figure 2:
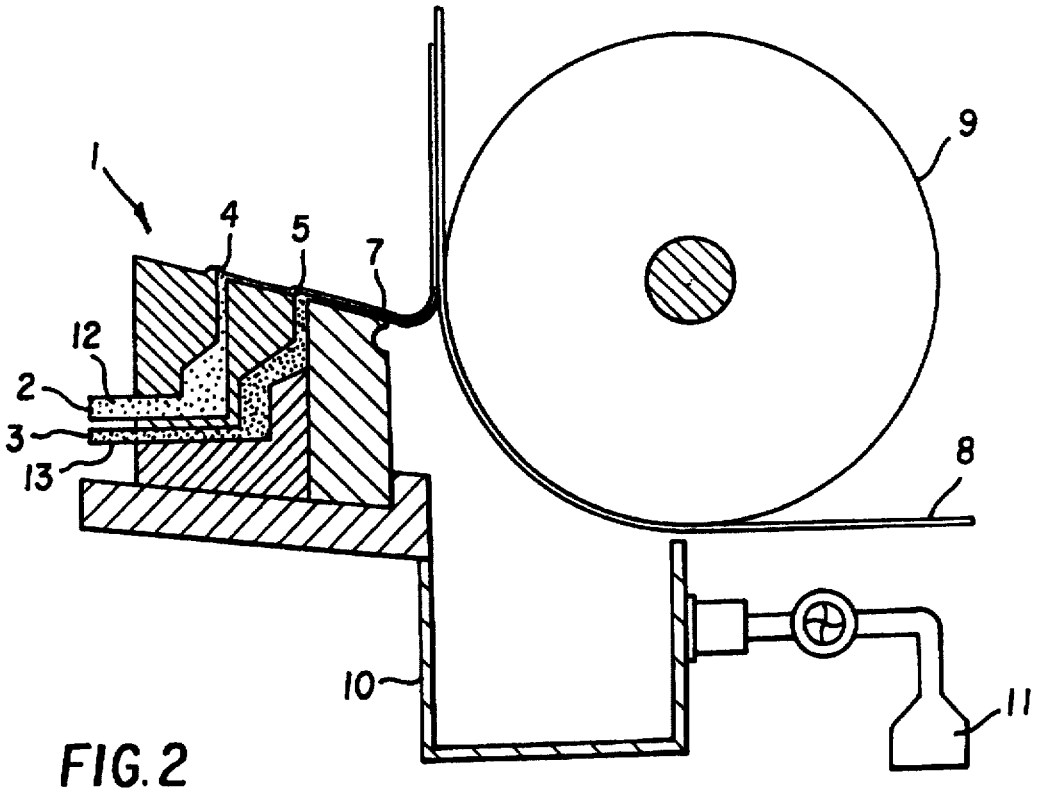
FIG. 2 is a drawing of a steady-state coating operation.

A preferred embodiment of the present invention is described below in detail with reference to FIG. 1, which is a side view showing the embodiment schematically. FIG. 1 shows conventional apparatus for metering a multilayer coating on a film support comprising a hopper 1 comprising two components 12,13 (assuming the support is to be coated with two layers) each component having an inlet 2,3 and an outlet 4,5 (exit slot) where the inlets allow each coating composition for each layer to be delivered to its compartment in the hopper and the outlets allow for the coatings to be delivered to the coating zone 6. Thus, the first layer of the coating will be applied from the compartment closest to the hopper lip 7. The coating hopper itself can be formed from materials such as stainless steel, titanium, and the like. Under steady state coating conditions, as depicted in FIG. 2, the lip 7 is at the coating zone which is the location where all the coating layers contact the support 8 which is carried by a coating roll 9. As shown in FIG. 1, a vacuum trough 10 supported by pump 11 can be used to create an air pressure differential as in U.S. Pat. No. 3,220,877.

The support or web that can be used in the present invention may be selected from a broad range of materials including paper, plastic films, metals, resin coated paper and synthetic paper. Plastic films may be made of the various materials including polyolefins such as polyethylene and polystyrene, vinyl polymers including polyvinyl acetate, polyvinyl chloride and polystyrene, polyamides such as nylon 6,6 and nylon 6, polyesters such as polyethylene terephthalate and polyethylene-2,6-naphthalate, polycarbonates, and cellulose acetates such as cellulose triacetate and cellulose diacetate. Resins for use in resin coated paper are typified by, but not limited to, polyolefins such as polyethylene. The morphology of the surface of resin coated paper is in no way limited, and it may or may not be embossed. Metallic webs may be exemplified by an aluminum web.

The operation of the apparatus to advantageously apply the coating composition is conventional. The coating layers, including the top layer, are applied from the exit slots 4,5 of the slide hopper. The layers which form the coating composition are applied at the hopper lip 7 to the support 8 which is being transported by the coating roll 9. This conventional hopper apparatus is useful in the method of the present invention for reducing defects caused by the start of the coating applications. In the present invention, the top layer of the coating composition is designed specifically in such a way as to remove the problems associated with all coating starts. In the present invention the top layer of the liquid coating composition is shear thinning.

The various layers which can be applied to the support include light sensitive emulsions, dispersions, and antihalation layers. The top layer, which is generally comprised of antistatic and gel polymers must be shear thinning, as described in "Dynamics of Polymeric Liquids", Vol I; P. B. Bird, R. C. Armstrong and O. Hassayin, 1977, Wiles & Sons, N.Y. The optimum composition of the shear thinning top coat layer is determined in accordance with the material of the support, the properties of the coating liquid and the movement speed of the support. We note here that there are other rheological properties which may also affect the compatibility between the coating composition and the support. Other properties, such as extensional viscosity, are also described in the cited reference.

The shear thinning polymer used in the top layer liquid composition has the feature that its viscosity decreases as its fluid elements are subjected to increased strain (distortion). For a shear thinning fluid, the shear stress $\tau$, is related to the rate of strain, $\underset{\sim}{\gamma}$, as $$g\tau=\eta$$

where $\eta$ is the viscosity, whose dependence is given as $$\eta=\eta(|\dot{\underset{\sim}{\eta}}|)$$

where $$|\dot{\underset{\sim}{\eta}}|$$

is the magnitude of the rate of strain.

With shear thinning polymers, the viscosity of the solution decreases as the applied strain rate increases. Because of this, a shear-thinning solution can exhibit different viscosities in different portions of a coating process. In particular, in low strain rate regions arising on the support or the slide (<300 $sec^{-1}$), the viscosity of a shear thinning layer will remain high. Yet in high strain rate regions where the shear thinning layer transitions from slide to support (50,000-$10^6$ $sec^{-1}$), the layer will shear thin to a low viscosity and thereby improve its wetting properties with respect to a support. As a result, the ability to start at higher coating speeds is achieved, without violating the higher viscosity top coat requirement elsewhere in the coating operation at steady-state (e.g. on the slide and support).

In order to modify fluid rheology to enhance a coating start, it is necessary to reduce the upper layer viscosity from an original value (determined from the requirements of steady-state operation) to some lower value. The reduced upper layer viscosity is referred to as the infinite shear viscosity. This is the lowest viscosity the fluid can attain regardless of polymer addition or strain rate. Once the desired infinite shear viscosity has been achieved, a viscosifying, shear thinning polymer is used to raise the viscosity of the fluid back to its original value. This original value is termed the low shear viscosity as it is measured at the lowest possible strain rate. At this shear rate, it should have a viscosity identical to the original viscosity. As the fluid is subjected to increasing strain rates, the viscosity will decrease until it asymptotically approaches its infinite shear viscosity.

In order to achieve high maximum wetting speeds, solution viscosities of the top coat layer must be kept low. Additionally, as the fluid shear thins, other rheological effects may become important and impact the ultimate wetting speed attained. The top layer of a coating composition is the first layer to impact the support. A high viscosity top layer guards against air flow induced coating streaks as well as promotes surfactant driven streak healing. Also, a high viscosity top layer is important in determining the physical properties of the film after drying. Thus, simply lowering a top layer viscosity to increase the maximum wetting speed may negatively impact a coating system. Leveraging the above technique for a high viscosity top layer will move wetting failure at coating starts to higher web speeds without further imperfections at steady-state.

The following examples illustrate the invention:

EXAMPLE 1

Experimentation was performed to investigate the effect of rheology modification on wetting failure at bead coating starts. A two layer system was used where the bottom layer was a 4 cP gelatin solution. The upper layer composition was varied, as indicated in Table 1, to attain differing degrees of shear thinning behavior. A 0.3 wt. % aqueous solution, containing Keltrol-T (manufactured by Kelco) as the viscosifying, shear thinning agent, was used in modifying layer rheology.

The surfactant TX-200E (manufactured by Rohm and Haas) was added to each top layer composition at a level of 22 $cm^3$/liter. To assist in sample visualization, a black carbon dispersion was included in the formulation. All coatings were made on gelatin subbed polyethylene terephthalate at flow rates of 2 and 3 $cm^2/s$ and pressure differentials of 62.5 and 187.5 Pa.

The experimental plan consisted of two parts. In part one, coating starts were performed using elements 1–3 from Table 1 as the top layer. As indicated, these fluids did not exhibit shear thinning behavior (i.e. the low and high shear viscosities are identical). The web speed was increased until wetting failure was noted. This value was recorded as the maximum wetting speed at which a coating start could be made. These non-shear thinning cases were run to establish a baseline for comparison of wetting failure with the shear thinning cases to follow.

TABLE 1

| Element Number | Low Shear Viscosity [cP] | Measured Rate of Strain [$s^{-1}$] | High Shear Viscosity [cP] | Measured Rate of Strain [$s^{-1}$] |
|---|---|---|---|---|
| 1 | 16 | 1 | 16 | $1.0 \times 10^4$ |
| 2 | 32 | 1 | 32 | $1.0 \times 10^4$ |
| 3 | 64 | 1 | 64 | $1.0 \times 10^4$ |
| 4 | 64 | 1 | 4 | $7.7 \times 10^3$ |
| 5 | 64 | 1 | 8 | $2.4 \times 10^3$ |
| 6 | 64 | 1 | 16 | $1.9 \times 10^3$ |
| 7 | 64 | 1 | 32 | $1.0 \times 10^3$ |

TABLE 1-continued

| Element Number | Low Shear Viscosity [cP] | Measured Rate of Strain [$s^{-1}$] | High Shear Viscosity [cP] | Measured Rate of Strain [$s^{-1}$] |
|---|---|---|---|---|
| 8 | 32 | 1 | 4 | $5.8 \times 10^3$ |
| 9 | 32 | 1 | 8 | $2.8 \times 10^3$ |
| 10 | 32 | 1 | 16 | $2.2 \times 10^4$ |
| 11 | 16 | 1 | 4 | $2.1 \times 10^4$ |

In part two, coatings were performed using elements 4–11 from Table 1 as the top layer. These elements did exhibit shear thinning behavior. Again, maximum wetting speed data was collected. All experimental data is summarized in FIG. 3.

Figure 3:
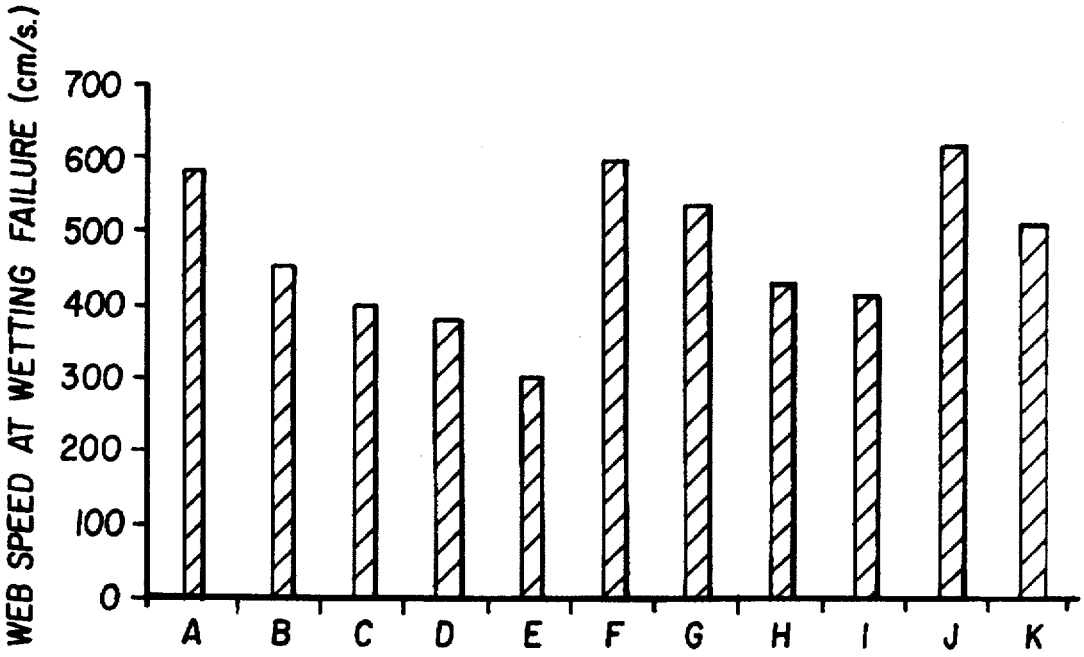
FIG. 3 is a graph of experimental data from Table 1.

FIG. 3 contains the maximum speed data for each of the 11 top layer elements of Table 1 plotted against its corresponding low shear viscosity wherein A is element 4 having a high shear viscosity 4 cP, B is element 5 having a high shear viscosity of 8 cP, C is element 6 having a high shear viscosity of 16 cP, D is element 7 having a high shear viscosity of 32 cP, E is element 3 having a high shear viscosity of 64 cP, F is element 8 having a high shear viscosity of 4 cP, G is element 9 having a high shear viscosity of 8 cP, H is element 10 having a high shear viscosity of 16 cP, I is element 2 having a high shear viscosity of 32 cP, J is element 11 having a high shear viscosity of 4 cP and K is element 1 having a high shear viscosity of 16 cP. This results in three distinct groups of data: A to E, F to I, J to K, grouped by low shear viscosities of 64, 32, and 16 cP, respectively. Within a group, the rightmost element always represents a top layer element devoid of the shear thinning agent; it is the traditional unadjusted top layer composition which is typically used in a coating operation. The following conclusions can be drawn from this experiment.

1. The data in FIG. 3 illustrates the utility of the invention in that the shear thinning cases (elements containing polymer) exhibit wetting failure at higher speeds than the non-shear thinning cases with the same low shear viscosity. Consequently, the ability to start at a faster support speed is realized without altering the desired low shear viscosity necessary for steady state coating.

2. The lower the high shear viscosity, the greater the support speed until wetting failure. This is presumably due to a lowering in viscosity of the top layer due to shear thinning at the coating start.

3. Similar results were obtained over the range of flow rates and vacuum levels surveyed thereby indicating the global utility of the invention in benefiting the coating process.

EXAMPLE 2

The experiment as outlined in Example 1 was repeated using an additional shear thinning agent. An 8.0 wt. % aqueous solution, comprised of the shear thinning agent, copoly(acrylamide-2-acrylamido-2-methylpropane sulfonic acid Na salt) 20/80 wt % (hereinafter termed Polymer 2), was used in modifying layer rheology. Also, a 0.3 wt. % solution of Keltrol-T (hereinafter referred to as Polymer 1) was again used in modifying layer rheology. The upper layer composition used in this experiment are indicated in Table 2.

TABLE 2

| Element Number | Low Shear Viscosity [cP] | Measured Rate of Strain [s − 1] | High Shear Viscosity [cP] | Measured Rate of Strain [s − 1] | Shear Thinning Agent |
|---|---|---|---|---|---|
| 12 | 64 | 1 | 64 | $1.0 \times 10^4$ | none |
| 13 | 64 | 1 | 8 | $1.7 \times 10^3$ | polymer 1 |
| 14 | 64 | 1 | 8 | $2.2 \times 10^4$ | polymer 2 |
| 15 | 64 | 1 | 16 | $1.6 \times 10^4$ | polymer 1 |
| 16 | 64 | 1 | 16 | $2.5 \times 10^4$ | polymer 2 |
| 17 | 64 | 1 | 32 | $4.1 \times 10^2$ | polymer 1 |
| 18 | 64 | 1 | 32 | $2.0 \times 10^4$ | polymer 2 |

As in Example 1, coatings were performed using the elements from Table 2 as the top layer of a two layer coating pack. The web speed was increased until wetting failure was noted. This value was recorded as the maximum wetting speed at which a coating start could be made. All experimental data is summarized in FIG. 4.

Figure 4:
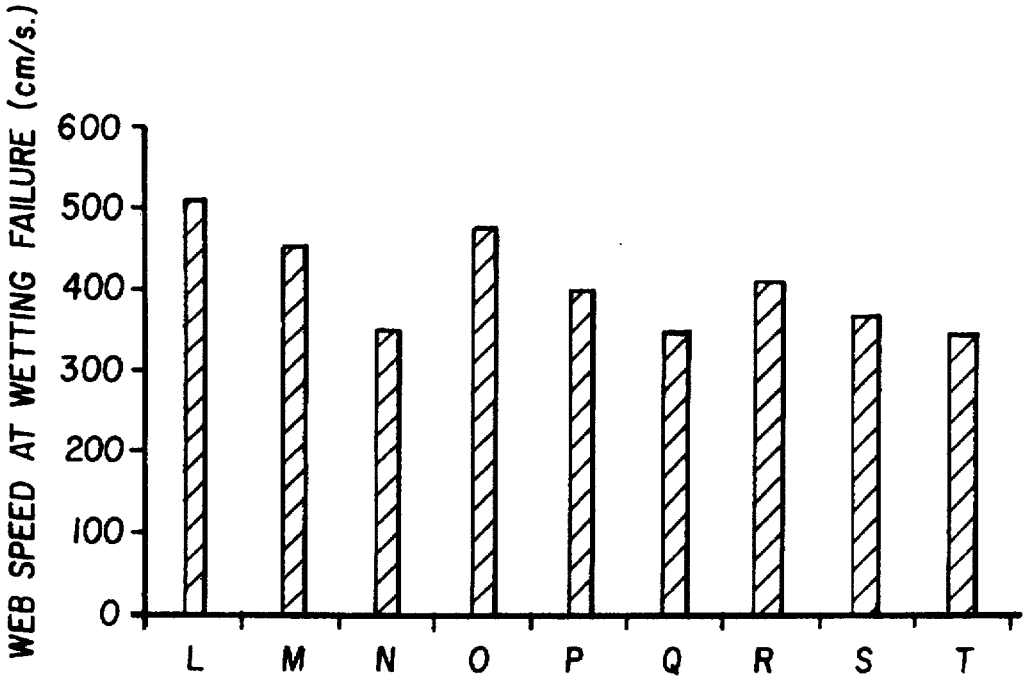
FIG. 4 is a graph of experimental data from Table 2.

FIG. 4 contains the maximum wetting speed data for each of the 9 top layer elements wherein L is element 13 incorporating polymer 1 having a high shear viscosity of 8 cP, M is element 14 incorporating polymer 2 having a high shear viscosity of 8 cP, N is element 12 having a high shear viscosity of 64 cP (not shear thinning), O is element 15 incorporating polymer 1 having a high shear viscosity of 16 cP, P is element 16 incorporating polymer 2 having a high shear viscosity of 16 cP, Q is element 12 having a high shear viscosity of 64 cP (not shear thinning), R is element 17 incorporating polymer 1 having a high shear viscosity of 32 cP, S is element 18 incorporating polymer 2 having a high shear viscosity of 32 cP and T is element 12 having a high shear viscosity of 64 cP (not shear thinning). This results in three distinct sets of data: L to N, O to Q, and R to T, grouped so that the high shear top layer viscosities attained with polymers 1 and 2 in each group are 8, 16, and 32 cP, respectively. Within each group, the rightmost element always represents a top layer element devoid of shear thinning polymer; it is the traditional unadjusted top layer composition which is typically used in a coating operation. The following conclusions can be drawn from this experiment:

1. The data in FIG. 4 again illustrates the utility of the invention in that the shear thinning cases (elements containing polymer) exhibited wetting failure at higher speeds, consequently, the ability to start at a higher speed is realized.

2. FIG. 4 also demonstrates that the choice of polymeric addendum can have an effect on the maximum wetting speed at which a coating start can be made.

As indicated in Table 2, elements with polymer 1 consistently achieved its high shear viscosity at lower rates of strain than for polymer 2. The data suggests that the actual viscosity coated onto the support in the top layer is lower for the elements containing polymer 1 than polymer 2. This is likely why higher wetting speeds were achieved for the elements containing polymer 1 as opposed to those containing polymer 2. The choice of different polymers can affect the liquid-support compatibility from a chemical perspective, which may also play a role in the data obtained. Additionally, other second-order rheological effects (e.g. extensional viscosity) may also play a role.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. A method of applying multiple layers of coating liquids to a moving support comprising:

moving a support along a path through a coating zone;

forming two or more layers including a topmost layer of coating liquid to form a liquid coating composition; and applying the liquid coating composition to the moving support in the coating zone wherein the topmost layer of the liquid coating composition is topmost before and after reaching the support and is shear thinning.

2. The method according to claim 1 wherein applying the liquid coating composition to the moving support is done by bead coating.

3. The method according to claim 1 wherein applying the liquid coating composition to the moving support is done by curtain coating.

4. The method of claim 1 wherein the topmost coating layer contains a viscosifying agent.

5. A method of applying multiple layers of coating liquids to a moving support comprising:

moving a support along a path through a coating zone;

forming two or more layers including a topmost layer of coating liquid to form a liquid coating composition; and applying the liquid coating composition to the moving support in the coating zone wherein the topmost layer of the liquid coating composition is topmost before and after reaching the support and is shear thinning, the liquid coating composition being determined by reducing the low shear viscosity of the topmost layer to a value such that a coating start can be made, then adding a shear thinning polymer into the reduced viscosity topmost layer such that the new low shear viscosity of the topmost layer is the same as the low shear viscosity of the original composition.

6. The method of claim 5 wherein the topmost coating layer contains a viscosifying agent.

7. The method of claim 5 wherein applying the liquid coating composition to the moving support is done by bead coating.

8. The method according to claim 5 wherein applying the liquid coating composition to the moving support is done by curtain coating.

* * * * *